United States Patent [19]

Arango

[11] Patent Number: 4,508,240

[45] Date of Patent: Apr. 2, 1985

[54] DEVICE FOR EXTRACTING PASTE FROM A TUBE

[75] Inventor: Aurelio Arango, Miami, Fla.

[73] Assignee: Miguel Angel Arango, Miami, Fla.

[21] Appl. No.: 459,390

[22] Filed: Jan. 20, 1983

[51] Int. Cl.[3] ..... B65D 35/54

[52] U.S. Cl. ..... 222/96; 222/401

[58] Field of Search ..... 222/80, 394, 399, 401, 222/402, 400.5, 94, 96, 92, 101, 391, 82

[56] References Cited

U.S. PATENT DOCUMENTS 1,071,890 9/1913 Desmond ..... 222/401

1,175,267 3/1916 Jacobs ..... 222/401

3,417,902 12/1968 Mirka ..... 222/96

*Primary Examiner*—Charles A. Marmor

*Assistant Examiner*—Kenneth Noland

*Attorney, Agent, or Firm*—Jesus Sanchelima

[57] ABSTRACT

This invention relates to the field of dispensing systems for the extraction of paste from squeezable tubes. Its features include puncturing the tube and forcing air pressure into same and apparatus for removal of predetermined amounts of paste. It is intended primarily as a dispenser for toothpaste to limit communicable disease transmission.

3 Claims, 5 Drawing Figures

80
50
27
28
20
52
51
55
53
23
29
10
30
24
22
92
93
25
94
95
P
40
43
79
T
42
41
70
44
45

DEVICE FOR EXTRACTING PASTE FROM A TUBE

BACKGROUND OF THE INVENTION

1. Field of the Invention

The present invention relates to a manually controllable material dispenser and more particularly, to a device adapted to dispense pastes and creams and even more particularly, to such devices which extract the paste or cream in predetermined amounts.

2. Description of the Prior Art

A number of devices have been produced which use various methodologies for dispensing pastes, but none employ the novel concept of the present invention. The solution described herein is thought to be unique and novel and is expected to have a lower cost for its implementation than those devices in the prior art.

Existing devices are described in U.S. Pat. Nos. 1,841,275; 3,417,902; 4,234,104; 2,001,983; and 2,623,659; which show the use of mechanical compression to extract paste from tubes. U.S. Pat. No. 2,792,856 discloses the use of negative air pressure in a two stroke device. None disclose the concept employed by the present invention which uses a pneumatic pump to create positive air pressure to urge paste from a tube.

Other patents describing the closest subject matter provide for a number of more or less complicated features that fail to solve the problems in an efficient and economical way. None of these patents suggest the novel features of the present invention.

SUMMARY OF THE INVENTION

It is the main object of the present invention to provide a paste dispenser that is capable of dispensing a predetermined amount of toothpaste on a toothbrush without requiring the use of both hands by the user.

It is another object of the present invention to provide a dispenser that is clean and prevents contact from one toothbrush to the tube, thereby eliminating the transmission of bacteria.

It is another object of the present invention to provide a device that will easily squeeze out all the paste of a tube.

It is a further object of this invention to provide a novel method for tube paste extraction.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5 depicts a cut-away side view of the preferred embodiment cut at line 5—5 from FIG. 3.

DETAILED DESCRIPTION OF THE PREFERRED EMBODIMENT

Figures 1, 2:
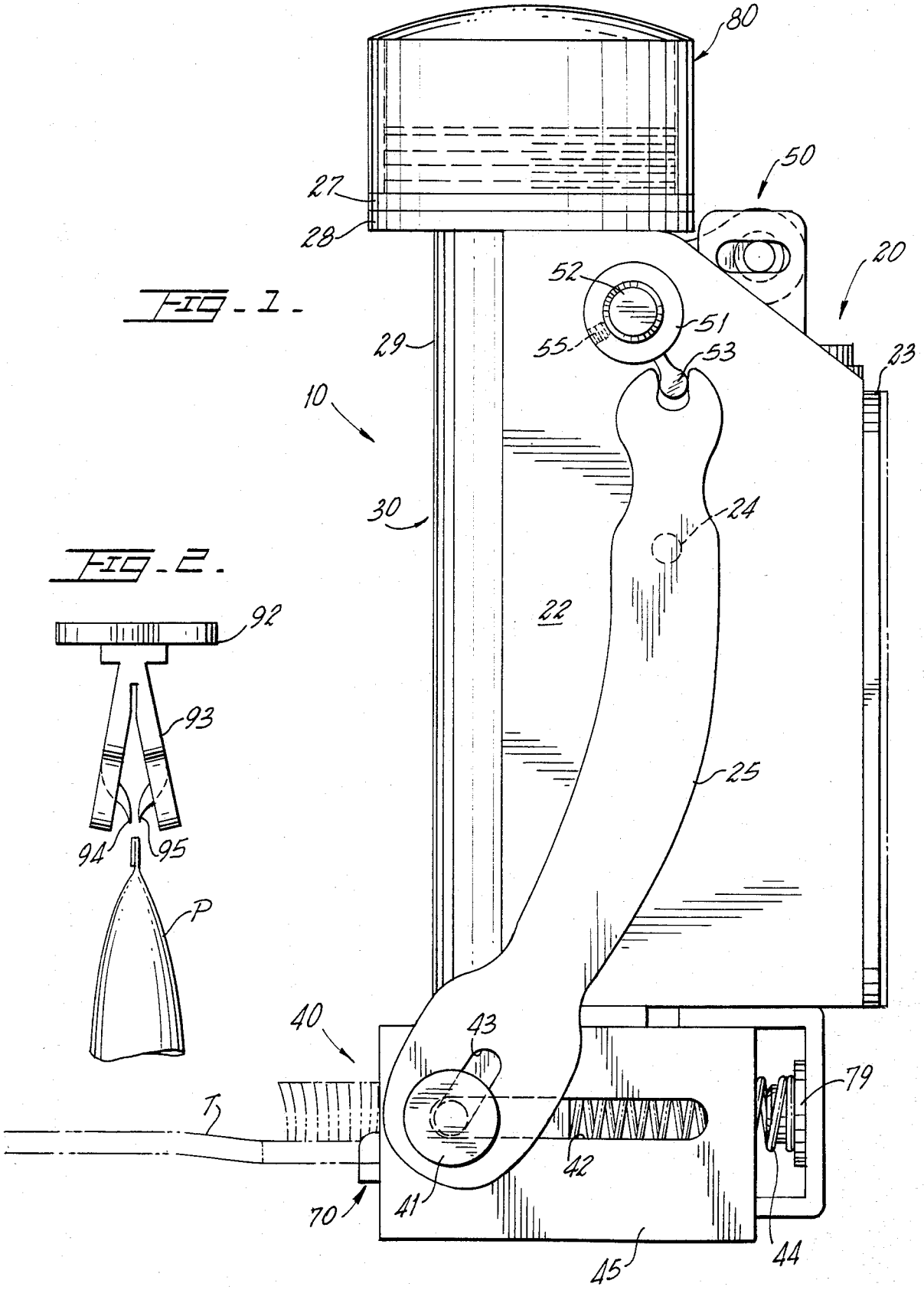
FIG. 1 is a side view of the preferred embodiment.
FIG. 2 depicts a side view of the puncture assembly of the preferred embodiment.

Referring now to the drawings wherein the dispenser is generally referred to with numeral 10, the details of construction will be shown.

In FIGS. 1 and 2, a side view of dispenser 10 and puncture assembly 90 are shown. In general, it comprises a housing assembly 20, a pneumatic assembly 30, a carrier assembly 40, including carrier stage 70 a linkage assembly 50 and a screw mounted cap 80 with attached puncture assembly 90. Basically, the user inserts toothbrush T into carrier assembly 40, at and into toothbrush guide 71 on carrier stage 70, pushing inwardly, and this motion is transmitted through linkage assembly 50 to pneumatic assembly 30 thereby creating a positive air pressure that urges the paste out of the tube.

Figure 3:
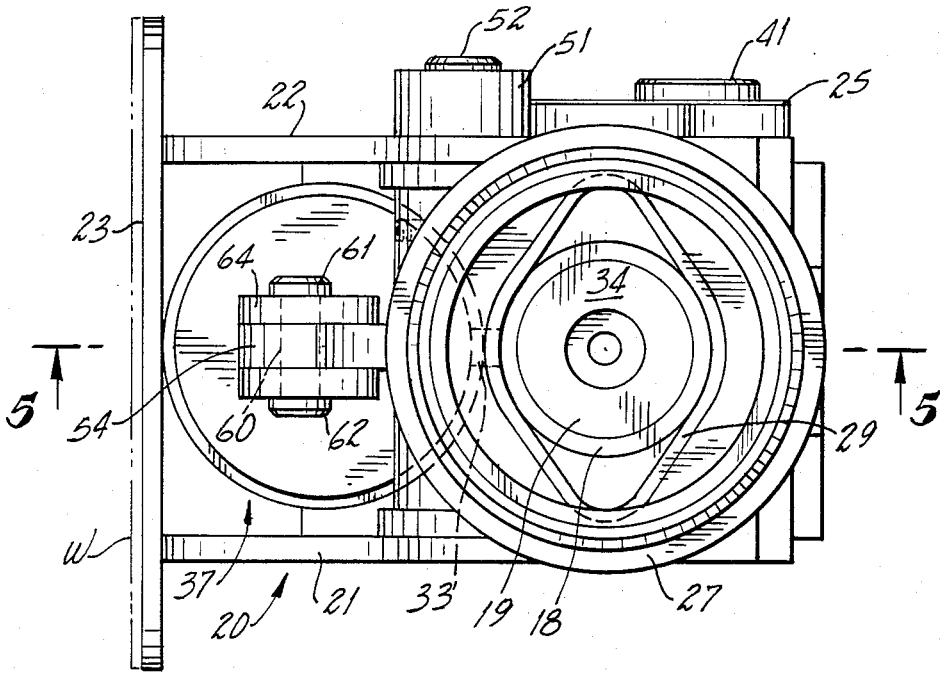
FIG. 3 is a top view of the preferred embodiment of the invention with the screw-mounted cap removed.

Housing assembly 20 is formed, in the preferred embodiment, by upright walls 21, 22 and 23 as shown in FIG. 3. Wall 21 is behind and parallel to wall 22 and so is not seen in FIG. 1, but is depicted in FIG. 3. Wall 22 is provided with pivot pin 24, as shown in FIG. 1, around which arm 25 pivots. One end of arm 25 is engaged to movable carrier stage 70, which is inside carrier assembly 40, through headed pin 41 which is guided along a horizontal path by longitudinal aperture 42 formed in carrier assembly wall 45. Enough leeway is provided to pin 41 by opening 43 to accommodate the vertical displacement of arm 25 with respect to aperture 42 as it rotates. The rotational motion of arm 25 is thus transmitted to linkage assembly 50 throug the other end of arm 25 which is engaged to protrusion 53 of axle ring 51 which is in turn rigidly mounted on axle 52 through set screw 55.

Figure 5:
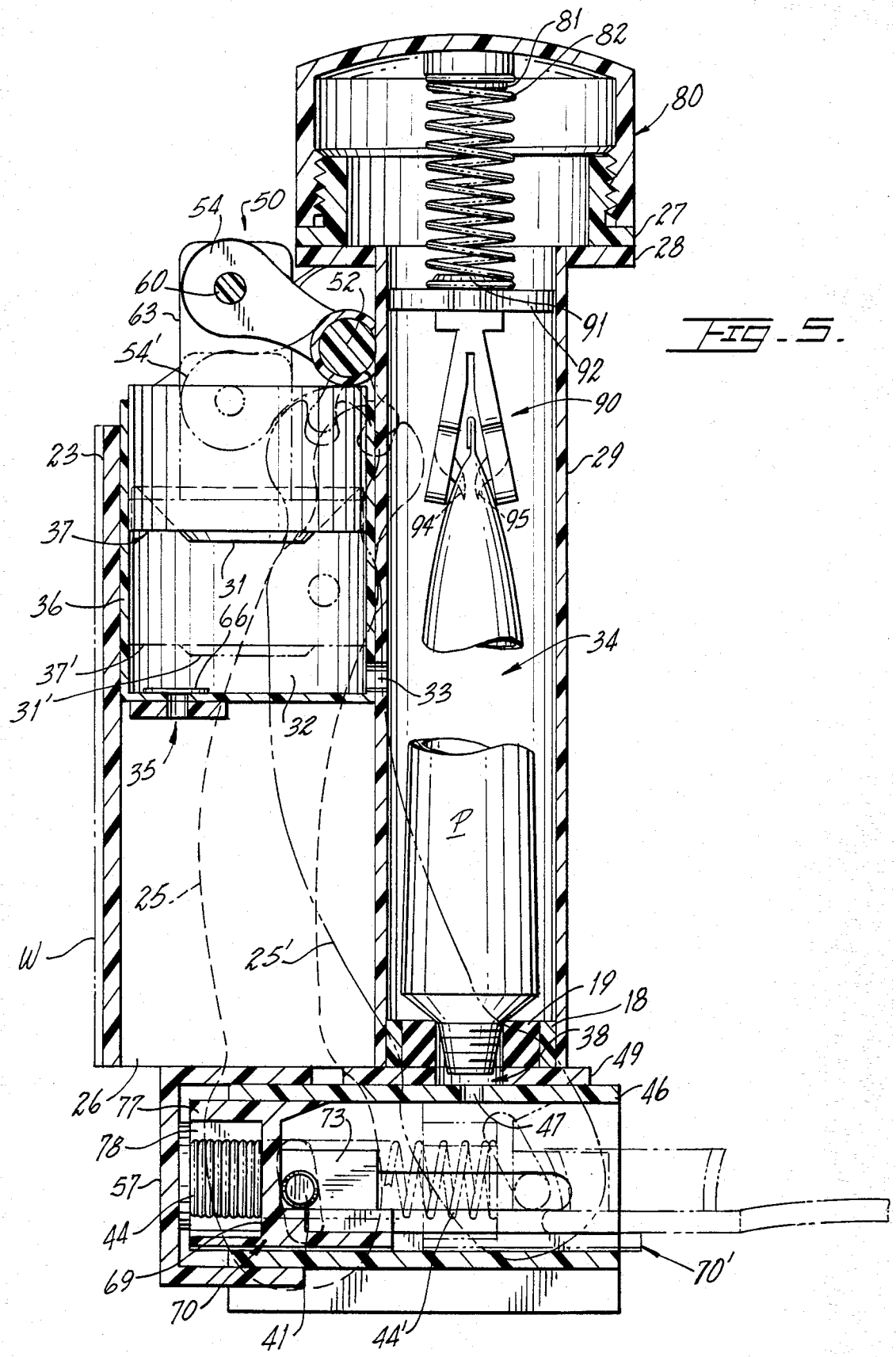
FIG. 5 depicts an angular view of the carrier stage assembly.

As it can be observed in FIG. 5, in broken lines, actuator 54' is in the lowest position responding to the motion transmitted by arm 25'. Actuator 54 is shown in its resting, or upper, position when it is brought back by the action of spring 44' when the force applied by the user is released. Actuator 54 is rigidly mounted on axle 52 and in rotatable connection to pin 60. Pin 60, held in place by pin caps 61 and 62 confers the motion of actuator 54 to piston 37, as shown in FIG. 3. On the downstroke of piston 37 in cylinder 36, piston face 31 compresses air in chamber 32, forcing same out through aperture 33 into tube chamber 34, as shown in FIG. 5. On the upstroke of piston 37, air is drawn into the chamber 32 through opening 26, thence by way of one-way-valve 35 into chamber 32. In the preferred embodiment, one-way-valve 35 is a flexible rubber flap 66 which is held at one end to the floor of chamber 32 by gluing. Air forces its way past the flap when piston 37 is raised but the flap 66 does not allow air to flow the other way.

Tube chamber 34 is sealed at the upper end by screw mounted cap 80. This cap 80 screws over support member 27 which is attached to chamber wall 29 by support member 28. Spring 82 presses puncture assembly 90 against the tube of paste P and is held therebetween by spring buttons 91 and 81. To operate puncture assembly 90, a tube of paste P is inserted into the open tube chamber 34, and rests on collar 19 in filler 18. Screw mounted cap 80 and attached puncture assembly 90 is then screwed over support member 27, forcing puncture points 94 and 95 on fork 93 against the wall of the paste filled tube. These points 94 and 95 remain oriented downwardly by virtue of stabilizing plate 92, and puncture the walls of the paste filled tube P, thus allowing the air pressure in tube chamber 34 into said tube P to urge said paste within, out.

Figure 4:
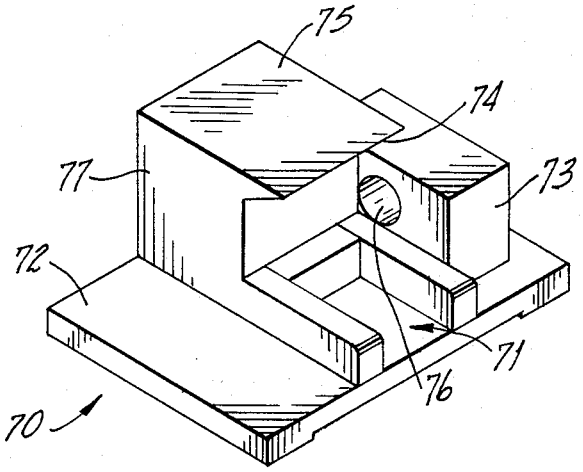

Referring now to FIG. 4, in which the carrier stage assembly 70 is depicted, it can be seen that it is constructed from three pieces; base 72, motion transfer block 73 and a cutting block 77. Toothbrush guide 71, cutter edge 74 and top plate 75 are formed from the cutting block 77. As shown in FIG. 5, spring 44 is in contact with inner wall 69 of cavity 78 in block 77 on one end and the other other end to spring button 79 which in turn is attached to wall 57 in carrier assembly 40 as shown in FIG. 5. A hole 76 is cut completely through motion transfer block 73 for the attachment to headed pin 41. Headed pin 41 is connected to carrier stage 70 by hole 76 in motion transfer block 73. The pieces 72, 73 and 77 are glued or formed together as shown in FIG. 4 in the preferred embodiment and the whole carrier stage 70 is slidably inserted into carrier assembly 40 and attached thereto by spring 41. The mounting is most clearly seen in FIG. 5 in which the carrier stage is depicted in its two extreme positions as 70 and 70'.

Thus, employing the combination of parts described, paste is extracted from tube P as described above and as follows. Pressure created by piston 37 being forced into cylinder 36 forces the air pressure in chamber 32 to enter tube chamber 34 through aperture 33. Said air pressure enters tube P through the apertures therein formed by puncture points 94 and 95, thus forcing said paste from said tube P into repository chamber 49. As carrier stage 70 reaches its backmost position, paste begins to extrude from dispensing nozzle 47 formed in upper wall 46, and continues to do so as toothbrush T is withdrawn and until on the return stroke of carrier stage 70 cutter edge 74 cuts it flow and top plate 74 seals dispensing aperture 47, leaving the device ready for the following operation. Headed pin 41 is connected to carrier stage 70 by hole 76 in motion transfer block 73.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A dispenser of toothpaste from a tube manually operated by a user by inserting a toothbrush comprising, in operative combination:

A. a housing;

B. an air-tight chamber mounted within said housing and adapted to receive said tube and further comprising a removable cap having a puncture assembly adapted to puncture said toothpaste tube so that the increased air pressure built up within said chamber facilitates the extraction of the paste from said tube;

C. pneumatic means for compressing air mounted within said housing and connected to said chamber, including a cylinder, a piston snuggly fitted within said cylinder, a one-way valve mounted on the bottom of said cylinder and an opening connected to said chamber so that air from the atmosphere may be admitted through said valve and compressed in said cylinder by said piston and injected into said chamber thereby increasing its relative air pressure;

D. carrier means slidably mounted on said housing and adapted to receive said toothbrush; and E. linkage means for transmitting the motion of said carrier means to actuate said pneumatic means.

2. A dispenser for dispensing measured amounts of paste from a paste containing tube onto an inserted brush comprising in operative combination:

A. a tube chamber for containing said paste containing tube having a nozzle in the bottom thereof and further comprising a removable cap having a puncture assembly adapted to puncture said toothpaste tube so that the increased air pressure built up within said chamber facilitates the extraction of the paste from said tube;

b. pneumatic means for compressing air in air connection with said tube chamber including a cylinder, a piston snuggly fitted within said cylinder a one-way-valve to allow the entrance of air into said cylinder and an opening connected to said chamber so that air from the atmosphere may be admitted through said valve and compressed in said cylinder by said piston and injected into said chamber thereby increasing its relative air pressure;

C. carrier means slidably connected beneath said tube chamber so as to seal and unseal said nozzle and adapted to receive said brush; and D. linkage means for transmitting motion of said carrier means to actuate said pneumatic means.

3. A dispenser as set forth in claim 2, wherein said tube chamber further comprises a screw mounted cap for air-tight sealing and also for admission of said paste containing tube thereinto; and further comprising a collar for the resting of the open end of said paste containing tube within said tube chamber wherein said collar permits said open end of said tube to be in communication with said nozzle.

* * * * *